US006860584B2

(12) United States Patent
Suzuki

(10) Patent No.: US 6,860,584 B2
(45) Date of Patent: Mar. 1, 2005

(54) IMAGE FORMING APPARATUS

(75) Inventor: Ryoma Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/460,163

(22) Filed: Jun. 13, 2003

(65) Prior Publication Data

US 2004/0070646 A1 Apr. 15, 2004

(30) Foreign Application Priority Data

Jun. 26, 2002 (JP) ..... 2002-186023

(51) Int. Cl.[7] ..... B41J 19/18
(52) U.S. Cl. ..... 347/37
(58) Field of Search ..... 347/37; 400/319, 400/320, 321, 322

(56) References Cited

U.S. PATENT DOCUMENTS 6,390,618 B1 * 5/2002 Wotton et al. ..... 347/102
6,601,944 B1 * 8/2003 Kawazoe ..... 347/37

* cited by examiner

*Primary Examiner*—Lamson D. Nguyen
(74) *Attorney, Agent, or Firm*—Fitzpatrick, Cella, Harper & Scinto

(57) ABSTRACT

An image forming apparatus, which performs recording by discharging ink onto a recording medium using a recording head that discharges the ink, includes a carriage that is mounted with the recording head and scans in a main scanning direction, a linear scale that is provided with graduations for detecting a position of the recording head mounted on the carriage and extends along the main scanning direction, a linear sensor that is fixed to the carriage and reads out the graduations on the linear scale by scanning in the main scanning direction on the linear scale together with the carriage, and an air guide that is arranged in a vicinity of the linear sensor in the main scanning direction and guides air moving toward the linear sensor as the carriage scans such that the air is directed away from the linear sensor. In the image recording apparatus, adhesion of ink mist to the linear sensor can be reduced.

20 Claims, 9 Drawing Sheets

IMAGE FORMING APPARATUS

BACKGROUND OF THE INVENTION

1. Field of the Invention

The present invention relates to an image forming apparatus of an ink jet system for forming an image by discharging ink from a recording head onto a recording medium.

2. Related Background Art

Up to now, as an output apparatus for a computer or a workstation, there is known an image forming apparatus of an ink jet system for forming an image by discharging ink onto a recording medium such as a recording paper that is transported in a predetermined direction. In general, the image forming apparatus of the ink jet system includes: a recording head provided with plural discharge ports which discharges ink therethrough; a carriage that carries the recording head and scans (reciprocates) in a predetermined main scanning direction; a linear scale for detection of a position of the recording head; and a linear sensor that is fixed to the carriage directly or through a member and reads out graduations formed on the linear scale by moving on the linear scale together with the carriage. The linear sensor is generally arranged in proximity to the recording head, so that the ink discharged from the recording head impacts the recording medium with high accuracy.

When an image is formed on the recording medium by the image forming apparatus of the ink jet system, the recording medium during transportation is temporarily stopped, and the carriage is made to reciprocate in the above-mentioned main scanning direction. At the same time, ink is discharged from ink discharge ports based on signals outputted from the linear sensor having read out the graduations on the linear scale and image signals representing image information. Thus, an image is formed on a portion of the recording medium corresponding to an image forming region that faces the ink discharge ports. After that, the recording medium is transported by a predetermined length and stopped. The carriage is again made to reciprocate in the main scanning direction, while the ink is discharged from the ink discharge ports based on the image signals, and another image is then formed on a different portion of the recording medium corresponding to the image forming region. The above-mentioned operation is repeated to form an image on the recording medium.

In the image forming apparatus of the ink jet system described above, the ink in a liquid state is discharged onto the recording medium to thereby form an image. Therefore, when the ink is discharged from the recording head, ink in a fine mist state (ink mist) occurs around an ink droplet. In addition, when the ink droplet impacts the recording medium, not all the ink mist is adsorbed to the recording medium instantaneously, and there is also a case where a portion of the ink droplet bounces off a surface of the recording medium due to the impact or the like and is scattered in the mist state, thereby generating the ink mist.

The ink mist thus caused is dispersed inside the image forming apparatus along with the scanning by the carriage. The dispersed ink mist adheres to parts or members inside the image forming apparatus. If the ink mist adheres to the linear sensor, there is a fear that the linear sensor erroneously reads out the graduations on the linear scale.

Therefore, there are cases where the linear sensor is arranged apart from the recording head. However, among those cases, there is a case where the accuracy cannot be obtained between the recording head and the linear sensor due to the flexure of a member existing between the recording head and the linear sensor, or the like. As a result, there is a fear that the impact accuracy of the ink discharged from the recording head is reduced. Alternatively, another problem is conceivable in that since the recording head and the linear sensor are arranged apart from each other, the size of the apparatus is increased.

SUMMARY OF THE INVENTION

The present invention has been made in view of the above circumstances, and therefore has an object to provide an image forming apparatus in which even if a linear sensor is arranged in proximity to a recording head, ink mist is unlikely to adhere to the linear sensor.

DESCRIPTION OF THE PREFERRED EMBODIMENTS

Hereinafter, a description will be made of embodiments of the present invention with reference to the drawings.

Embodiment 1

Embodiment 1 of the present invention will be described using FIGS. 1 to 7.

Figure 1:
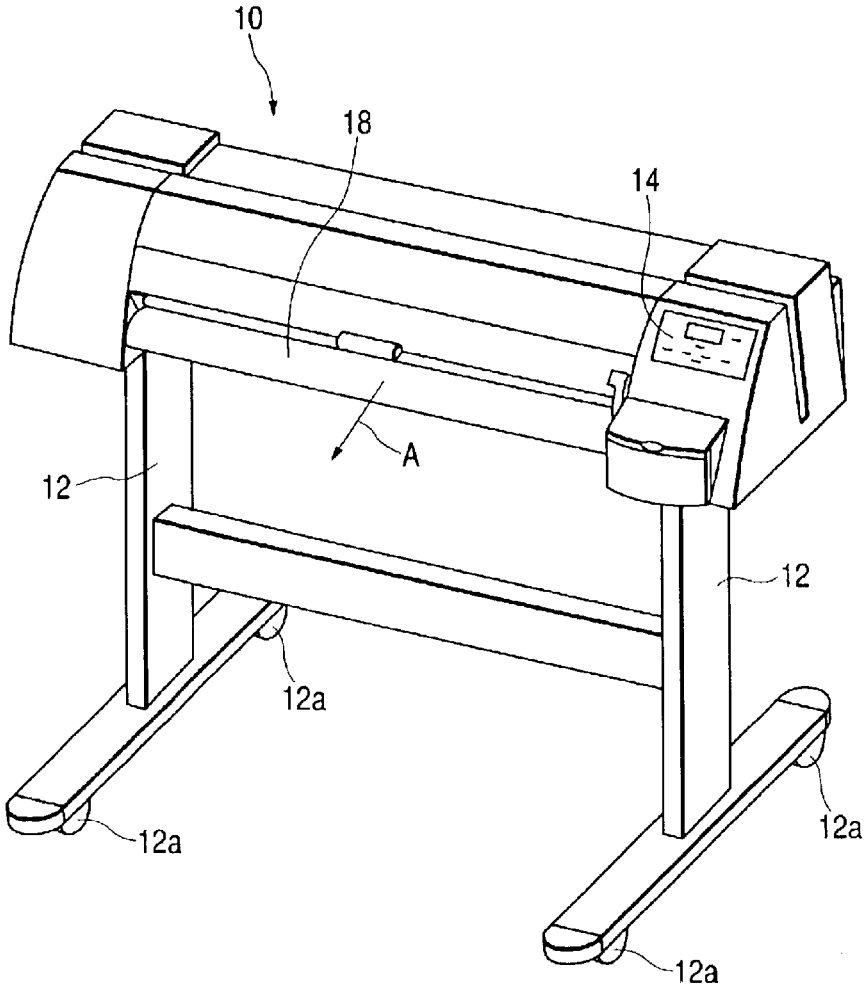
FIG. 1 is a perspective view of a plotter as an example of an image forming apparatus according to the present invention as viewed from its front side.
Figure 2:
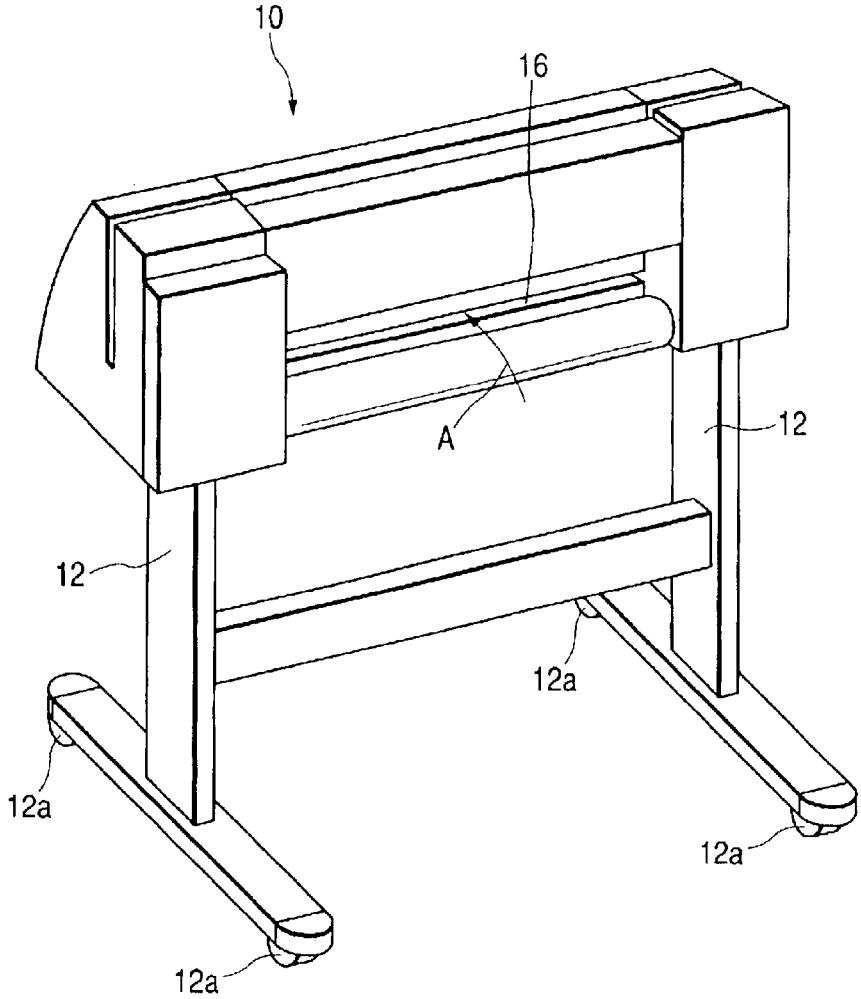
FIG. 2 is a perspective view of the plotter shown in FIG. 1 as viewed from its rear side.

FIG. 1 is a perspective view showing a schematic structure of a plotter as viewed from its front side. FIG. 2 is a perspective view showing a schematic structure of the plotter as viewed from its rear side.

A plotter 10 is fixed to an upper portion of a stand 12 attached with casters 12*a*. The plotter 10 is provided with an operation part 14 for operating the plotter 10. Through various switches and the like, instructions are given with regard to a paper size, on-line/off-line, a command, and the like.

As shown in FIG. 2, the rear surface of the plotter 10 is provided with a recording paper inlet 16 through which a recording paper (an example of a recording medium) such as a roll paper is inserted in a direction indicated by an arrow A. The recording paper inserted to the recording paper inlet 16 is transported to an inside of the plotter 10 based on the instruction from the operation part 14. Then, after a color image is recorded on the recording paper, the recording paper is delivered from a recording paper outlet 18 in the direction of the arrow A (sub scanning direction).

Figure 3:
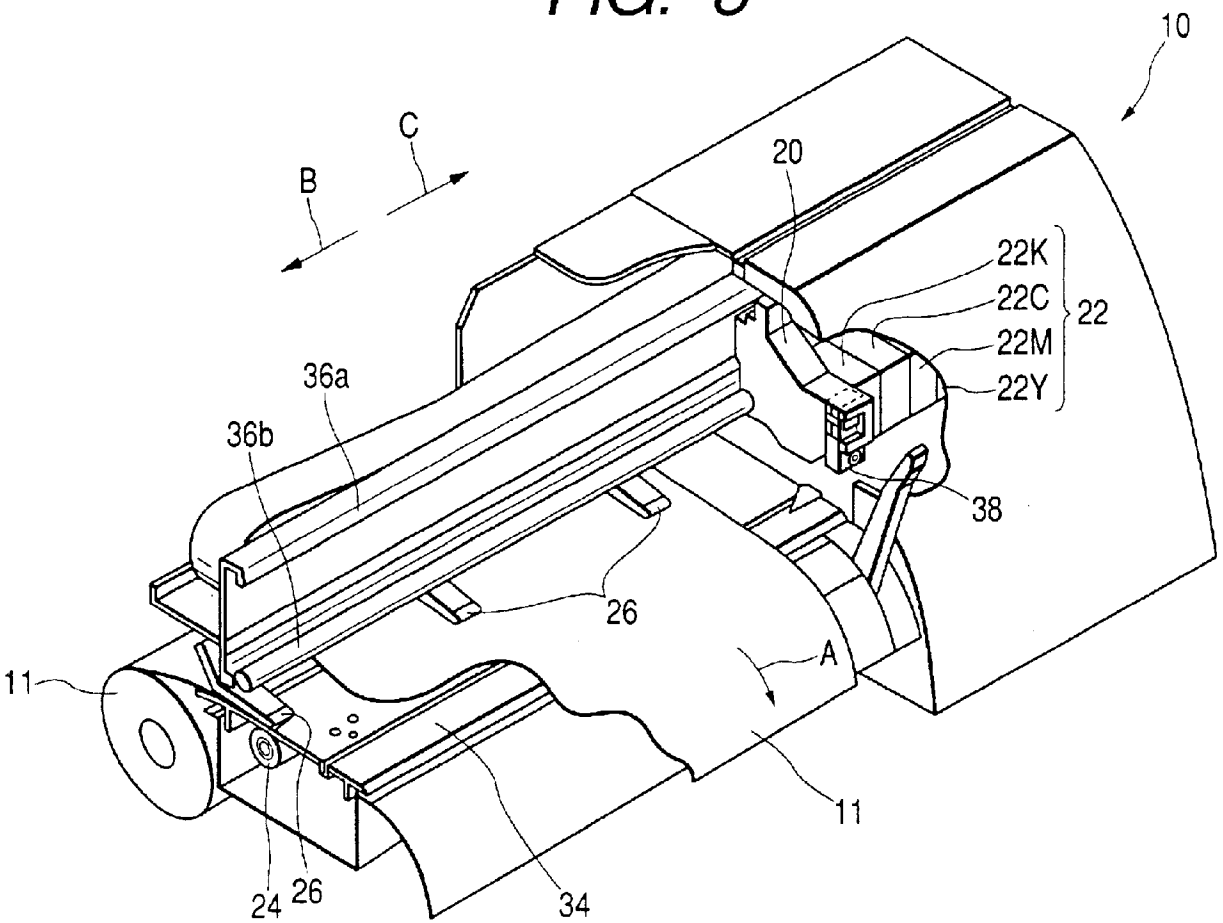
FIG. 3 is a partially sectioned perspective view of the plotter shown in FIG. 1.

FIG. 3 is referenced to describe an image forming process (recording process) of forming an image on a recording medium.

FIG. 3 is a partially sectioned perspective view of the plotter.

The plotter 10 is capable of forming an image on each of a sheet-shaped recording medium (sheet paper or the like) and a recording paper wound in a roll shape (roll paper or the like). Here, a description will be made of a process of forming an image on the roll paper inserted to the recording paper inlet 16. A process of forming an image on the sheet paper or the like is substantially the same.

On the rear surface of the plotter 10, a roll paper 11 is rotatably held. The roll paper 11 is inserted to the recording paper inlet 16 in the direction of the arrow A. The plotter 10 is also provided with a platen 34 on which the roll paper 11 to be transported in the direction of the arrow A is placed. Over the platen 34, two scanning rails (guide rails) 36*a* and 36*b* are laid in parallel with the platen 34. A carriage 20 that reciprocates (scans) in directions indicated by arrows B and C (directions perpendicular to the direction indicated by the arrow A; main scanning directions in the present invention) by a motor (not shown) and a belt (not shown) is attached to the scanning rails 36*a* and 36*b* through a slide bearing (not shown).

The carriage 20 is mounted with four recording heads 22K, 22C, 22M, and 22Y, each including an ink discharge port (outlet of a nozzle; not shown) that discharges ink. Defined in front of each ink discharge port is an image forming region where an image is to be formed. Onto a portion of the roll paper 11 corresponding to the image forming region, the ink is discharged from tips of the nozzles, thereby forming an image on the portion of the roll.

In order to form an image on the roll paper 11, the roll paper 11 is first placed on the platen 34, and then nipped between (1) a transport roller 24 of which a portion of an outer peripheral surface is exposed through an opening portion (not shown) formed in the platen 34, and (2) the pinch roller 26 which presses both end portions of the roll paper 11 from above. By rotating the thus nipped transport roller 24 by a transport motor (not shown), the roll paper 11 is transported in the direction of the arrow A. Subsequently, the carriage 20 is reciprocated above the roll paper 11 in the directions of the arrows B and C, and the ink is discharged from the nozzles based on image signals containing image information that are transmitted from a head control part (not shown) to the respective recording heads 22K, 22C, 22M, and 22Y. Thus, an image is formed on the portion of the roll paper 11 corresponding to the image forming region. After the image has been formed on the portion, the roll paper 11 is transported by a predetermined length in the direction of the arrow A, and another image is then formed on a different portion of the roll paper 11 corresponding to the image forming region. The above-mentioned operation is repeated to complete image formation within a predetermined range (regions) of the roll paper 11. After that, a cutter 38 is used to cut the roll paper 11 into a predetermined size, thereby ending the image forming operation temporarily.

When the ink is discharged from the respective recording heads 22K, 22C, 22M, and 22Y for the purpose of the above-mentioned image forming operation, ink in a fine mist state (ink mist) occurs around an ink droplet. When the ink droplet impacts the recording medium, there is also a case where a portion of the ink droplet bounces off a surface of the recording medium due to the impact or the like and is scattered in the mist state, thereby generating the ink mist. The ink mist adheres to a member inside an image forming apparatus. If its amount is increased, the ink mist grows and becomes an ink droplet. FIGS. 4 to 7 are referenced to describe a technique for making it difficult for the ink mist to adhere to a linear sensor.

Figure 4:
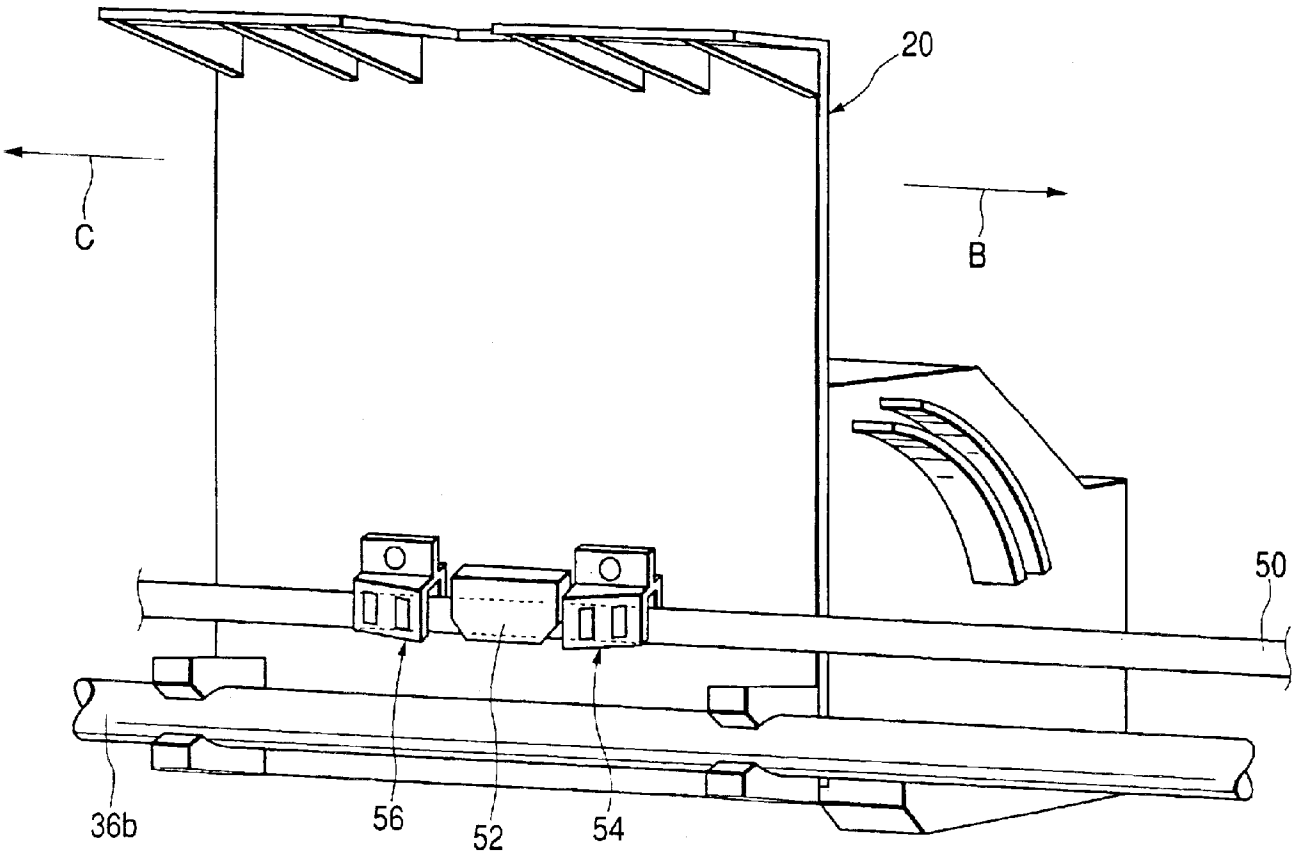
FIG. 4 is a perspective view of a carriage, to which a linear sensor and air guides are fixed, of the plotter shown in FIG. 1 as viewed from its rear side.
Figure 5:
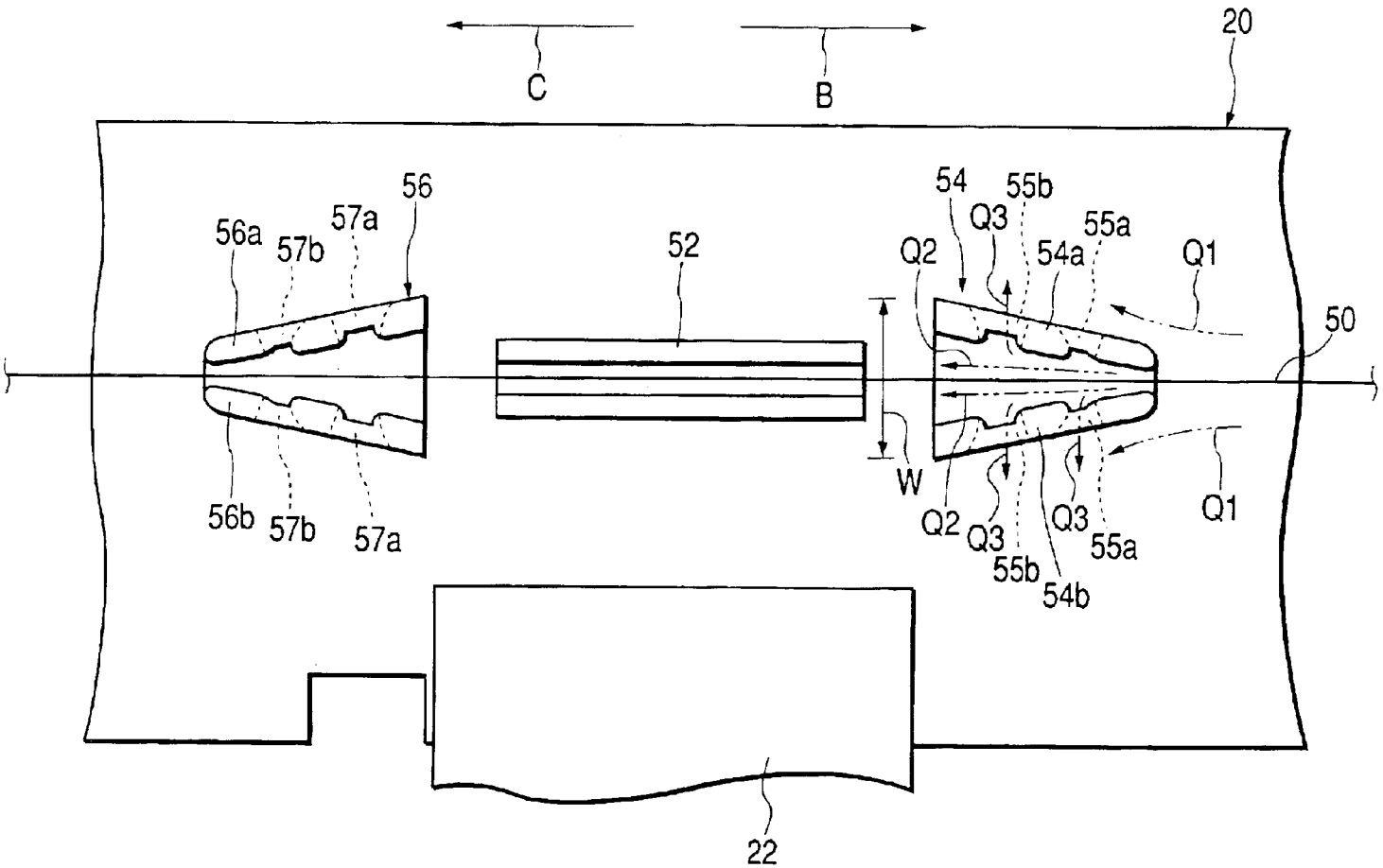
FIG. 5 is a bottom view of the carriage shown in FIG. 4.
Figure 6:
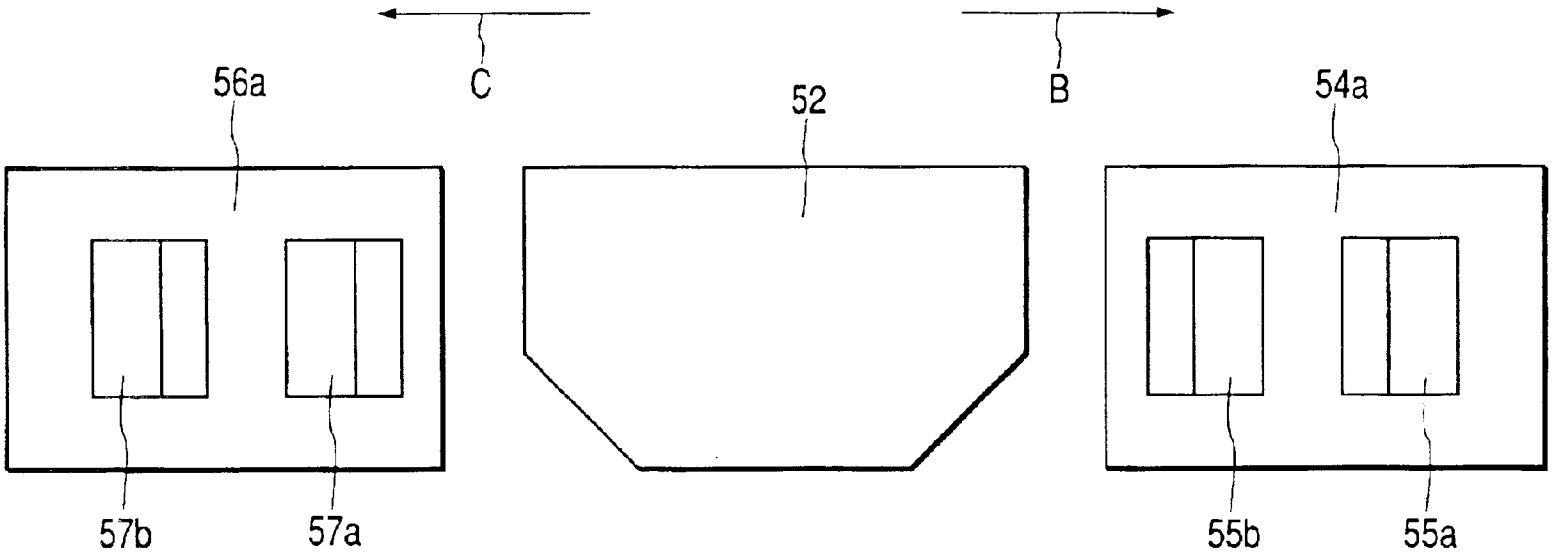
FIG. 6 is a side view of the air guides and the linear sensor.
Figure 7:
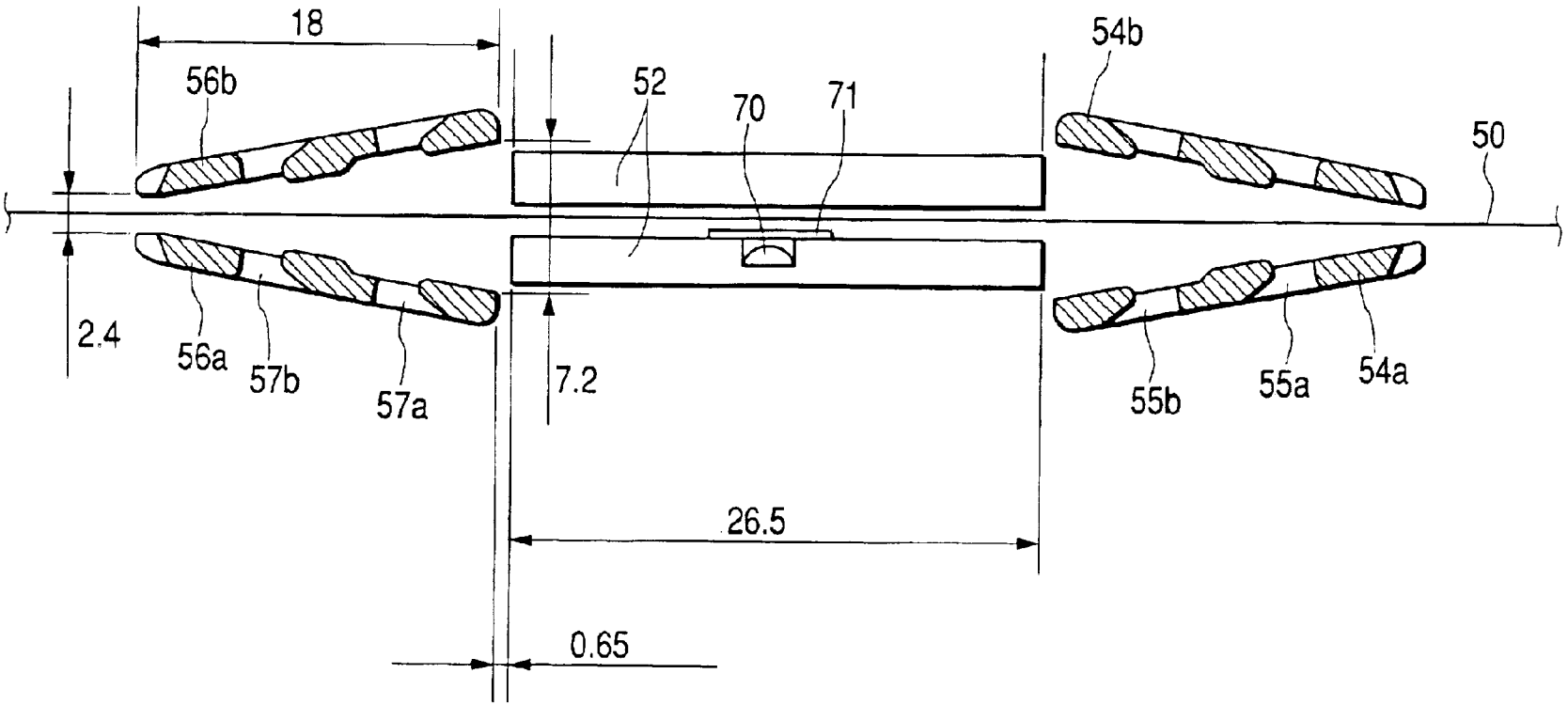
FIG. 7 is a sectional view of the air guides and the linear sensor.

FIG. 4 is a perspective view of a carriage to which the linear sensor and air guides are fixed, as viewed from its rear side (side opposite to that in FIG. 3). FIG. 5 is a bottom view of the carriage shown in FIG. 4. FIG. 6 is a side view of the air guides and the linear sensor. FIG. 7 is a sectional view of the air guides and the linear sensor. In FIGS. 4 to 7, the same symbols denote the same structural components as those in FIG. 3.

Arranged above the scanning rail 36*b* is a linear scale 50 for detecting a position of a recording head 22. The linear scale 50 is fixed to a main body of the plotter 10 and has a thin plate shape that extends in the main scanning direction. Also, on the linear scale 50, graduations (not shown) are formed for detection of the position of the recording head 22.

To the front surface of the carriage 20, the recording head 22 is mounted, and to the rear surface of the carriage 20, a linear sensor 52 that reads out the graduations of the linear scale 50 is fixed. The graduations of the linear scale 50 are read by the linear sensor 52 to thereby detect the position of the carriage 20, while the ink is discharged from the recording head 22.

Arranged in a portion of the carriage 20 in proximity to the linear sensor 52 are air guides 54 and 56 that make it difficult for the ink mist to adhere to the linear sensor 52 during scanning of the carriage 20. Within the portion in proximity to the linear sensor 52, the air guides 54 and 56 are arranged in positions between which the linear sensor 52 is put in the main scanning direction. The air guide 54 is arranged toward the direction of the arrow B with respect to the linear sensor 52, and the air guide 56 is arranged toward the direction of the arrow C with respect to the linear sensor 52.

The air guide 54 includes a pair of guide parts that are each opposed to the graduations (not shown) on the linear scale 50 and face each other via the linear scale 50. The pair of guide parts of the air guide 54 may be structured to be formed of one member and have portions facing each other via the linear scale 50, or may be structured to be formed of separate members (hereinafter, the guide parts are referred to as plate members). The air guide 54 is structured to have a pair of plate members 54*a* and 54*b* facing each other. The plate members 54*a* and 54*b* are formed along the main scanning direction (direction of the arrow B or C), and arranged not in parallel with but obliquely to the main scanning direction. The pair of plate members 54*a* and 54*b* face each other across the linear scale 50 and are arranged on both sides across the linear scale 50. Also, the pair of plate members 54*a* and 54*b* are arranged to become closest to the linear scale 50 in their portions maximally apart from the linear sensor 52, and to have a larger distance therebetween as the pair of plate members become closer to the linear sensor 52. Portions of the pair of plate members 54*a* and 54*b* which are closest to the linear sensor 52 have a distance W therebetween larger than the width of the linear sensor 52.

In addition, as shown in FIG. 6, openings 55*a* and 55*b* are formed in the pair of plate members 54*a* and 54*b*, respectively. FIG. 7 is used to show a sectional shape of the openings 55*a* and 55*b*. As shown in FIG. 7, a shape of each opening is formed to have an oblique surface on the linear sensor 52 side and become wider as the opening extends from an inside (linear scale 50 side) to an outside. If the description is made in a state where the air guide 54 composed of the pair of plate members 54*a* and 54*b* is made to scan in the direction of the arrow B, that is, with its portion maximally apart from the linear sensor 52 as a leading edge, the shape of the opening becomes wider as the opening extends backward in the direction against air flow through the air guide 54. FIG. 6 shows only the openings 55*a* and 55*b* in the plate member 54*a*. However, as shown in FIGS. 5 and 7, the plate member 54*b* is also provided with the openings 55*a* and 55*b*. Note that two openings 55*a* and 55*b* are formed here in one plate member 54*a*, but one opening or three or more openings may be formed in one plate member 54*a*.

The air guide 56 is arranged to be bilaterally symmetrical with respect to the linear sensor 52 and has a structure similar to that of the air guide 54. More specifically, the air guide 56 is structured to have a pair of plate members 56*a* and 56*b* facing each other. The plate members 56*a* and 56*b* are arranged along the main scanning direction (direction of the arrow B or C) not in parallel with but obliquely to the main scanning direction. The pair of plate members 56*a* and 56*b* face each other across the linear scale 50 and are arranged on both sides across the linear scale 50. Also, the pair of plate members 56*a* and 56*b* are arranged to become closest to the linear scale 50 in their portions maximally apart from the linear sensor 52, and to have a larger distance therebetween as the pair of plate members become closer to the linear sensor 52. Portions of the pair of plate members 56*a* and 56*b* which are closest to the linear sensor 52 have the distance W therebetween larger than the width of the linear sensor 52.

In addition, as shown in FIG. 6, openings 57*a* and 57*b* are formed in the pair of plate members 56*a* and 56*b*, respectively. As shown in FIG. 7, a shape of each of the openings 57*a* and 57*b* is formed to have an oblique surface on the linear sensor 52 side and becomes wider as the opening extends from an inside (linear scale 50 side) to an outside. If the description is made in a state where the air guide 56 composed of the pair of plate members 56*a* and 56*b* is made to scan in the direction of the arrow C, that is, with its portion maximally apart from the linear sensor 52 as a leading edge, the shape of the opening becomes wider as the opening extends backward in the direction against air flow through the air guide 56. FIG. 6 shows only the openings 57*a* and 57*b* in the plate member 56*a*. However, as shown in FIGS. 5 and 7, the plate member 56*b* is also provided with the openings 57*a* and 57*b*. Note that two openings 57*a* and 57*b* are formed here in one plate member 56*a*, but one opening or three or more openings may be formed in one plate member 56*a*. In addition, a light emitting part and a light receiving part are provided in a portion of the linear sensor 52 which faces the linear scale 50 (portion provided with a reading unit that reads out the graduations), and an optical lens 70 is attached to a surface of the light emitting part. Generally, lest the optical lens 70 contacts the linear scale, the optical lens 70 is provided in a recess that is formed to have at least a depth equal to the thickness of the optical lens 70. However, if air containing the ink mist flows to the vicinity of the light emitting part, the air forms an eddy due to the recess and stays in the recess, thereby allowing an easy adhesion of the ink mist to the optical lens 70. As a countermeasure, as shown in FIG. 7, a film 71 is applied so as to cover the recess in which the optical lens 70 exists, and the recess is eliminated to form a plane. It becomes possible to prevent the air from remaining due to the absence of the recess, and to reduce the adhesion of the ink mist to the light emitting part. Although shown to be thick in FIG. 7, the film 71 is exaggerated for illustrating the existence of the film. The actual film is an extremely thin film having a thickness of approximately 0.1 to 0.2 mm and forms substantially a plane, thereby causing no effect on the air flow.

As described above, the ink is discharged from the recording head 22, thereby generating the ink mist. FIG. 5 is used here to describe the flow of the ink mist when the carriage 20 is moving toward the direction of the arrow B.

When the carriage 20 is moving toward the direction of the arrow B, the air flow indicated by arrows Q1, Q2, and Q3 with chain double-dashed lines is generated. As described above, the pair of plate members 54*a* and 54*b* are arranged obliquely so as to have a larger distance therebetween as the pair of plate members extend closer to the linear sensor 52. Further, the pair of plate members 54*a* and 54*b* are spaced apart from each other at their portions closest to the linear sensor 52 by a distance equal to or larger than the thickness of the linear sensor 52. Therefore, as shown by the arrow Q1, there occurs air flow that passes outside the pair of plate members 54*a* and 54*b* along an external surface thereof, and further passes outside of the linear sensor 52. Meanwhile, as shown by the arrow Q2, there also occurs air flow that passes through a region (area) defined between the pair of plate members 54*a* and 54*b*. Moreover, as shown by the arrow Q3, there also occurs air flow that passes through the openings 55*a* and 55*b* to the outside from the region (area) defined between the pair of plate members 54*a* and 54*b*. This is because the above-mentioned arrangement, in which the shape of each of the openings 55*a* and 55*b* becomes wider as the opening extends backward in the direction against the air flow, facilitates the air made to flow into the region (area) defined between the pair of plate members 54*a* and 54*b* to flow to the outside of the pair of plate members 54*a* and 54*b*. In addition, the flow rate of the air indicated by the arrow Q1 is faster than the flow rate of the air indicated by the arrow Q2, resulting in occurrence of the air flow indicated by the arrow Q3. The ink mist is floating in the air and made to move along with the air flow. Therefore, the ink mist is also made to move along with the air flow indicated by the arrows Q1 to Q3. Accordingly, the ink mist in the air flow indicated by the arrow Q1 does not adhere to the linear sensor 52. Further, the ink mist in the air flow indicated by the arrow Q2 enters the region (area) defined between the pair of plate members 54*a* and 54*b*, but is delivered out of the region through the opening along with air flow indicated by the arrow Q3. In other words, the ink mist in the air flow indicated by the arrow Q2 does not adhere to the linear sensor 52 as well. As described above, by providing in proximity to the linear sensor the air guide having a simple structure in which the pair of plate members face each other along the main scanning direction and have a larger distance therebetween as the plate members extend closer to the linear sensor, the air flow can be produced, in which the air in the carriage scanning part containing the ink mist is moved away from the linear sensor. Thus, there can be provided an image forming apparatus in which the ink mist is kept away from the linear sensor. Also, by providing the openings in the plate members of the air guide, the air containing the ink mist made to flow to the linear sensor is further reduced, thereby allowing the adhesion of the ink mist to the linear sensor to be further reduced. Moreover, even in the case where the air containing the ink mist made to flow as indicated by the arrow Q2 reaches the linear sensor 52, a plane without unevenness is formed in the vicinity of the light emitting part of the linear sensor 52, thereby preventing the air from staying. Thus, the adhesion of the ink mist to the linear sensor can be still further reduced. As a result, an amount of the ink mist to adhere to the portion of the linear sensor 52 which is opposed to the linear scale 50 is reduced compared to the case of not using the air guide 54, thereby making it difficult for the ink mist to adhere to the linear sensor 52. Therefore, it can be prevented that the linear sensor 52 erroneously reads out the graduations on the linear scale 50. Accordingly, the impact accuracy of the ink discharged from the recording head 22 is not reduced, so that an image with high quality can be formed.

In the case where the carriage 20 moves in the direction of the arrow C, the air guide 56 is used to produce the same effects as those described above in accordance with the air guide 54. Accordingly, whichever direction the carriage 20 moves in during its reciprocation, the adhesion of the ink mist to the linear sensor 52 can be reduced.

Embodiment 2

Embodiment 2 of the present invention will be described using FIGS. 8 and 9.

Figure 8:
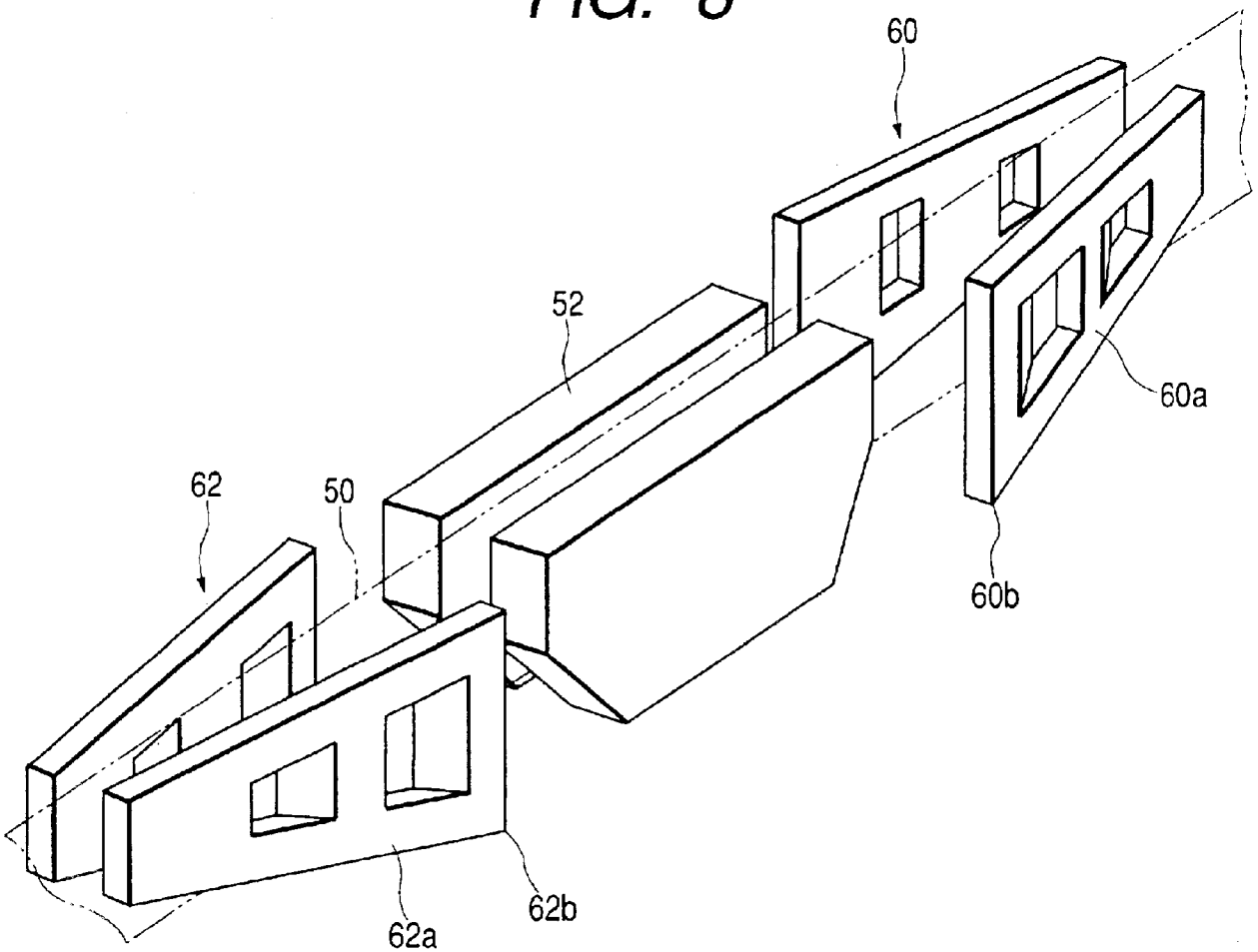
FIG. 8 is a perspective view of air guides used in an image forming apparatus according to the second embodiment of the present invention.
Figure 9:
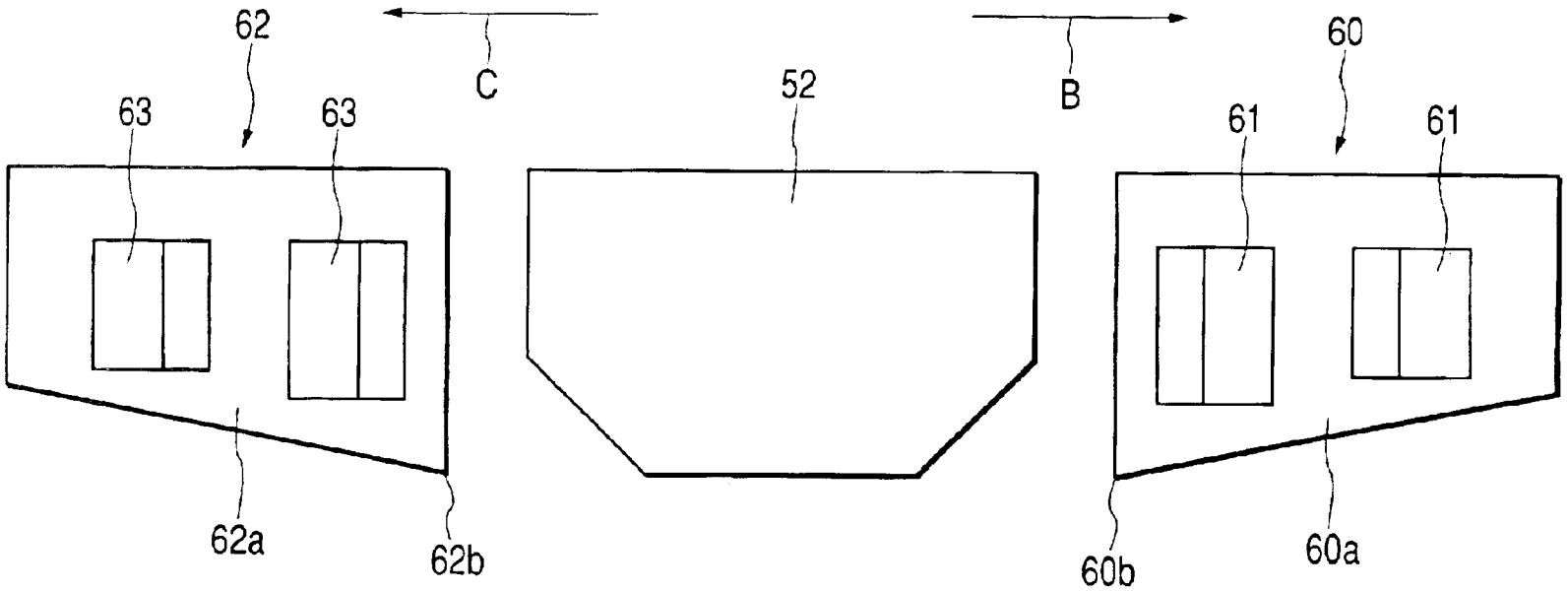
FIG. 9 is a side view of the air guides and a linear sensor used in the image forming apparatus according to the second embodiment of the present invention.

FIG. 8 is a perspective view showing another example of the air guides. FIG. 9 is a side view showing the other example of the air guides.

The features of air guides 60 and 62 reside in that the air guides 60 and 62 include bottom portions 60*a* and 62*a*, respectively, which are arranged obliquely to become lower in positions as the bottom portions 60*a* and 62*a* extend closer to the linear sensor 52. Otherwise, the same arrangements as those of the air guides 54 and 56 according to Embodiment 1 apply to Embodiment 2 regarding the positional arrangement of the air guides 60 and 62; the openings 61 and 63 being formed; a pair of plate members being arranged obliquely so as to have a larger distance therebetween as the pair of plate members extend closer to the linear sensor 52, and as shown in FIG. 5, being spaced apart from each other by the distance W equal to or larger than the width of the linear sensor 52; and the like. Also, the structure of the linear sensor 52 is the same as in Embodiment 1. Therefore, the same effects as obtained in Embodiment 1 can also be obtained in Embodiment 2. In addition, the following effects can be obtained due to the features of Embodiment 2.

The lowest position in the bottom portion 60*a*, 62*a* is a portion 60*b*, 62*b* that is closest to the linear sensor 52. The portion 60*b*, 62*b* is in a position maximally apart from the linear scale 50. Thus, when the ink mist adhering to the air guide 60, 62 has grown to become an ink droplet and drops down, the ink droplet drops down from the lowest portion 60*b*, 62*b*. As described above, the portion 60*b*, 62*b* is in the position maximally apart from the linear scale 50, so that there is no fear that the dropping ink mist adheres to the linear scale 50. Accordingly, the linear scale 50 is free from stain due to the ink mist dropping from the air guide 60, 62.

As described above, according to this embodiment, the air guide is provided in proximity to the linear sensor, so that the air containing the ink mist can be kept away from the linear sensor. Accordingly, there can be provided an image forming apparatus in which the ink mist is unlikely to adhere to the linear sensor.

Further, according to this embodiment, even if the linear sensor is arranged in proximity to the recording head, the ink mist is unlikely to adhere to the linear sensor, so that it can be prevented that the linear sensor erroneously reads out the graduations on the linear scale. Accordingly, there can be provided an image forming apparatus having a high recording quality, in which the impact accuracy of the ink discharged from the recording head is not reduced.

Further, according to this embodiment, the air guides arranged in proximity to both ends of the linear sensor each have a simple structure in which the pair of plate members face each other along the main scanning direction and have a larger distance therebetween as the plate members extend closer to the linear sensor, so that the air flow can be produced, in which the air in the carriage scanning part containing the ink mist is moved away from the linear sensor. Accordingly, there can be provided an image forming apparatus in which the ink mist is kept away from the linear sensor.

Further, according to this embodiment, the pair of plate members composing the air guide are each provided with an opening, and the ink mist entering the region defined between the pair of plate members is then delivered out of the region through the opening. Accordingly, there can be provided an image forming apparatus in which the ink mist is unlikely to adhere to the linear sensor.

Further, according to this embodiment, the pair of plate members composing the air guide are spaced apart from each other at their portions closest to the linear sensor by a distance equal to or larger than the thickness of the linear sensor. Accordingly, there can be provided an image forming apparatus in which the ink mist is more unlikely to adhere to the linear sensor.

Further, according to this embodiment, the pair of plate members composing the air guide include the bottom portions that are arranged obliquely to become lower as the bottom portions extend closer to the linear sensor, so that the ink mist adhering to the pair of plate members drops down in the position apart from the linear scale. Accordingly, there can be provided an image forming apparatus in which the ink mist is unlikely to adhere to the linear scale.

Further, according to this embodiment, even if the air containing the ink mist is made to flow between the air guides to reach the linear sensor, unevenness is eliminated from the portion of the linear sensor opposed to the linear scale to form a plane, thereby preventing the air from staying. Accordingly, there can be provided an image forming apparatus in which the ink mist is still more unlikely to adhere to the linear sensor.

What is claimed is:

1. An image forming apparatus that performs recording by discharging ink onto a recording medium using a recording head that discharges the ink, comprising:

a carriage that is mounted with the recording head and scans in a predetermined main scanning direction;

a linear scale that is provided with graduations for detecting a position of the recording head mounted to the carriage and extends along the main scanning direction;

a linear sensor that is fixed to the carriage and reads out the graduations on the linear scale by scanning in the main scanning direction along the linear scale together with the carriage; and an air guide that is arranged in a vicinity of the linear sensor in the main scanning direction and guides air moving toward the linear sensor as the carriage scans such that the air is directed away from the linear sensor.

2. An image forming apparatus according to claim 1, wherein the air guide comprises plural air guides which are arranged in vicinities of both ends of the linear sensor in the main scanning direction.

3. An image forming apparatus according to claim 2, wherein each air guide includes a pair of guide parts that are each opposed to the graduations on the linear scale and face each other via the linear scale, and the pair of guide parts have a larger distance therebetween as the pair of guide parts extend closer to the linear sensor.

4. An image forming apparatus according to claim 3, wherein portions of the pair of guide parts which are closest to the linear sensor have a larger distance therebetween than a width of the linear sensor.

5. An image forming apparatus according to claim 4, wherein the pair of guide parts in each air guide is provided with an opening.

6. An image forming apparatus according to claim 5, wherein the opening in the pair of guide parts has a shape that becomes wider as the opening extends backward in the direction against air flow through each air guide.

7. An image forming apparatus according to claim 6, wherein a bottom portion of the pair of guide parts has a shape that descends downward as the bottom portion extends closer to the linear sensor.

8. An image forming apparatus according to claim 7, wherein a portion of the linear sensor which is opposed to the linear scale is a plane.

9. An image forming apparatus according to claim 4, wherein a bottom portion of the pair of guide parts has a shape that descends downward as the bottom portion extends closer to the linear sensor.

10. An image forming apparatus according to claim 6, wherein a portion of the linear sensor which is opposed to the linear scale is a plane.

11. An image forming apparatus according to claim 3, wherein the pair of guide parts in each air guide is provided with an opening.

12. An image forming apparatus according to claim 11, wherein the opening in the pair of guide parts has a shape that becomes wider as the opening extends backward in the direction against air flow through each air guide.

13. An image forming apparatus according to claim 1, wherein the air guide includes a pair of guide parts that are each opposed to the graduations on the linear scale and face each other via the linear scale, and the pair of guide parts have a larger distance therebetween as the pair of guide parts extend closer to the linear sensor.

14. An image forming apparatus according to claim 13, wherein portions of the pair of guide parts which are closest to the linear sensor have a larger distance therebetween than a width of the linear sensor.

15. An image forming apparatus according to claim 14, wherein the pair of guide parts in the air guide is provided with an opening.

16. An image forming apparatus according to claim 15, wherein the opening in the pair of guide parts has a shape that becomes wider as the opening extends backward in the direction against air flow through the air guide.

17. An image forming apparatus according to claim 14, wherein a bottom portion of the pair of guide parts has a shape that descends downward as the bottom portion extends closer to the linear sensor.

18. An image forming apparatus according to claim 13, wherein the pair of guide parts in the air guide is provided with an opening.

19. An image forming apparatus according to claim 18, wherein the opening in the pair of guide parts has a shape that becomes wider as the opening extends backward in the direction against air flow through the air guide.

20. An image forming apparatus according to claim 1, wherein a portion of the linear sensor which is opposed to the linear scale is a plane.

* * * * *